US006131325A

United States Patent [19]

Kefer

[11] Patent Number: 6,131,325

[45] Date of Patent: Oct. 17, 2000

[54] SAFETY MECHANISM FOR RIFLES WITH A CYLINDRICAL BREECH

[75] Inventor: Hubert Kefer, Bad Ischl, Austria

[73] Assignee: Steyr Daimler Puch Aktiengesellschaft, Vienna, Austria

[21] Appl. No.: 09/194,893

[22] PCT Filed: Jun. 6, 1997

[86] PCT No.: PCT/AT97/00116

§ 371 Date: Dec. 4, 1998

§ 102(e) Date: Dec. 4, 1998

[87] PCT Pub. No.: WO97/47940

PCT Pub. Date: Dec. 18, 1997

[30] Foreign Application Priority Data

Jun. 7, 1996 [AT] Austria ..... 987/96

[51] Int. Cl.[7] ..... F41A 17/00

[52] U.S. Cl. ..... 42/70.05

[58] Field of Search ..... 42/70.08

[56] References Cited

U.S. PATENT DOCUMENTS

| | | | |
|---|---|---|---|
| 469,900 | 3/1892 | Ostrander | 42/70.08 |
| 827,893 | 8/1906 | Thorneycroft | 42/70.08 |
| 978,092 | 12/1910 | Wesson | 42/70.08 |
| 2,460,598 | 2/1949 | Rosvall | 42/70.05 |
| 3,184,876 | 5/1965 | Walther | 42/70.08 |
| 4,282,795 | 8/1981 | Beretta | 42/70.08 |
| 4,926,574 | 5/1990 | Rieger | 42/70.05 |
| 5,067,266 | 11/1991 | Findlay | 42/70.08 |
| 5,086,579 | 2/1992 | Flatley et al. | 42/70.08 |
| 5,245,776 | 9/1993 | Dornaus | 42/70.08 |
| 5,437,120 | 8/1995 | Dornaus | 42/70.08 |

*Primary Examiner*—Michael J. Carone
*Assistant Examiner*—Denise J Buckley
*Attorney, Agent, or Firm*—Bachman & LaPointe, P.C.

[57] ABSTRACT

A safety device for rifles having a housing (1) which accommodates a breech body (3) and having an operating part (14) which is arranged on the butt grip and is operatively connected to a catch (12) for a release plunger (30) which is loaded, when the breech is cocked, by the force of a firing pin spring (7), and in the case of which items a breech holder (10) is provided in the vicinity of the catch (12), can be lowered against the force of a spring and engages in a guide groove (11) in the breech body (3), is intended to be improved and, furthermore, the operating convenience is intended to be increased. To this end, the operating part (13) is connected in an articulated manner to a safety element (18) and to a slide rod (24); the catch (12) has, at the bottom, a stop surface (21), and the breech holder (10) has a first transverse pin (23); the safety element (18) has a first stop edge (20) and a second stop edge (22); the slide rod (24) has a control ramp (25) which interacts with a second transverse pin (26) in the breech holder (10) in such a manner that, in a further safe position of the operating part (13), the breech holder (10) is lowered.

6 Claims, 6 Drawing Sheets

SAFETY MECHANISM FOR RIFLES WITH A CYLINDRICAL BREECH

BACKGROUND OF THE INVENTION

The invention relates to a safety device for rifles having a housing which accommodates a breech body and having an operating part which is arranged on the butt grip and is operatively connected to a catch for a release plunger which is loaded, when the breech is cocked, by the force of a firing pin spring, and in the case of which items a breech holder is provided in the vicinity of the catch, can be lowered against the force of a spring and engages in a guide groove in the breech body.

A safety device of this generic type has been disclosed in AT-PS 388610. In the case of rifles equipped with such safety devices or rifles equipped with known similar safety devices, there is room for improvement with regard to safety and operating convenience. The breech body can be removed and fitted again only when the weapon safety catch has been released. If this is done with the magazine fitted and a cartridge is fed in when the breech body is inserted, the rifle is not in a safe state. In order to operate the breech holder, it is necessary either to press the trigger or to operate a further control element close to the trigger. There is thus a risk of incorrect action.

The object of the invention is therefore to overcome the defects mentioned above in such safety devices and, furthermore, to improve the operating convenience.

SUMMARY OF THE INVENTION

The forgoing object is achieved according to the invention wherein:

a. the operating part is connected in an articulated manner to a safety element and to a slide rod, b. the catch has, at the bottom, a stop surface, and the breech holder has a first transverse pin, c. the safety element has a first stop edge and a second stop edge, in which case, in the safe state, the first stop edge is located against the stop surface, and the second stop edge is located against the first transverse pin, and d. the slide rod has a control ramp which interacts with a second transverse pin in the breech holder in such a manner that, in a further safe position of the operating part, the breech holder is lowered.

The safety element acts on the catch and on the breech holder. Thus, when the operating part is in the safe position, no shot can be discharged, and the breech holder cannot be lowered when the safety catch has been released. The slide rod is used to operate the breech holder. The slide rod lowers the breech holder when, for example, the operating part is moved to a further safe position. All the safety functions can thus be controlled from the operating part. Since the safety element and slide rod may be flat sheet-metal parts, the space requirement and manufacturing cost are low.

The double function of the safety element can be achieved particularly easily if it is a two-armed lever which can rotate about an axis located somewhat under the first stop edge, and whose rear end has a slot which is guided on a pin in the operating part, and at whose front end the second stop edge is located. The sliding guidance in the slot allows the pin on the operating part also to be used at the same time for connection to the slide rod, even if, advantageously, the safety element is arranged on one side of the breech holder and the slide rod is arranged on the other side of the breech holder (claim 3).

In an advantageous development of the invention, the breech body has a first circumferential tab, and the slide rod has a third stop edge, which fixes the first circumferential tab in the further safe position of the operating part, so that the breech body cannot be moved to its unlocked position (claim 4). The slide rod thus also carries out a second function in addition, by which means a further safety gap is closed.

Furthermore, it is within the context of the invention for the breech body to have a second circumferential tab which is shorter in the longitudinal direction than the first circumferential tab and rests against the operating part of the third stop edge when the breech body is in the safe-for-transportation position and the operating part is in the further safe position (claim 5). The additional safe-for-transportation position of the breech body can be provided in various ways, for example as described in the simultaneously submitted Patent Application WO 97/47941 from the applicant. It can be moved to this position only when the operating part is in the further safe position, in that it is rotated a small amount further, beyond the locked position, by means of the bolt handle. In the process, the rear of the tab slides over the third stop edge, and the tab finally latches in so that the breech body is held in this position. As a result of the fact that the second circumferential tab is shorter in the longitudinal direction than the first circumferential tab, the breech body can be rotated back to the normal lock position again only if the operating part is moved back from the further safe position to the normal safe position.

If the breech body is now held in the safe-for-transportation position, against the force of the firing pin spring, when the operating part is located in the further safe position, then the breech body automatically jumps back to the normal lock position.

BRIEF DESCRIPTION OF THE DRAWINGS

The invention will be described and explained in the following text with reference to illustrations in which

In FIG. 1, the breech housing is denoted by 1. In its interior, it has a cylindrical guide surface 2 in which a cylindrical breech body 3 is guided such that it can be moved longitudinally and can rotate. A plug 4 is arranged behind it and can be displaced with the breech body 3 in the longitudinal direction, but cannot be rotated with the latter. An end cap 5 is also fitted to the plug 4. A firing pin 6 is guided in the interior of the breech body 3 such that it can be moved longitudinally, and a firing pin spring 7 acts on it in the firing direction, with a bent 8 being attached to its rear part. A trigger housing 9 is screwed to the underneath of the breech housing 1. Only part of this can be seen and its contents are not illustrated, in the same way as a safety catch which is likewise present and is located in the trigger housing—for example in the rear part. A breech holder 10 is guided in the trigger housing 9 such that it can be moved vertically, and is spring-loaded in the upward direction. This breech holder 10 engages in a guide groove 11 in the breech body 3. This guide groove 11 first of all runs in the circumferential direction and then forward in the axial direction over the majority of the length of the breech body 3. At the front it forms a stop which prevents the breech body 3 from being pulled out completely when the breech holder 10 is in the position shown. Finally, 12 also denotes a catch which is mounted in the trigger housing 9, holds the bent 8 against the force of the firing pin spring 7 in the firing position, and is released to fire a shot.

Figure 1:
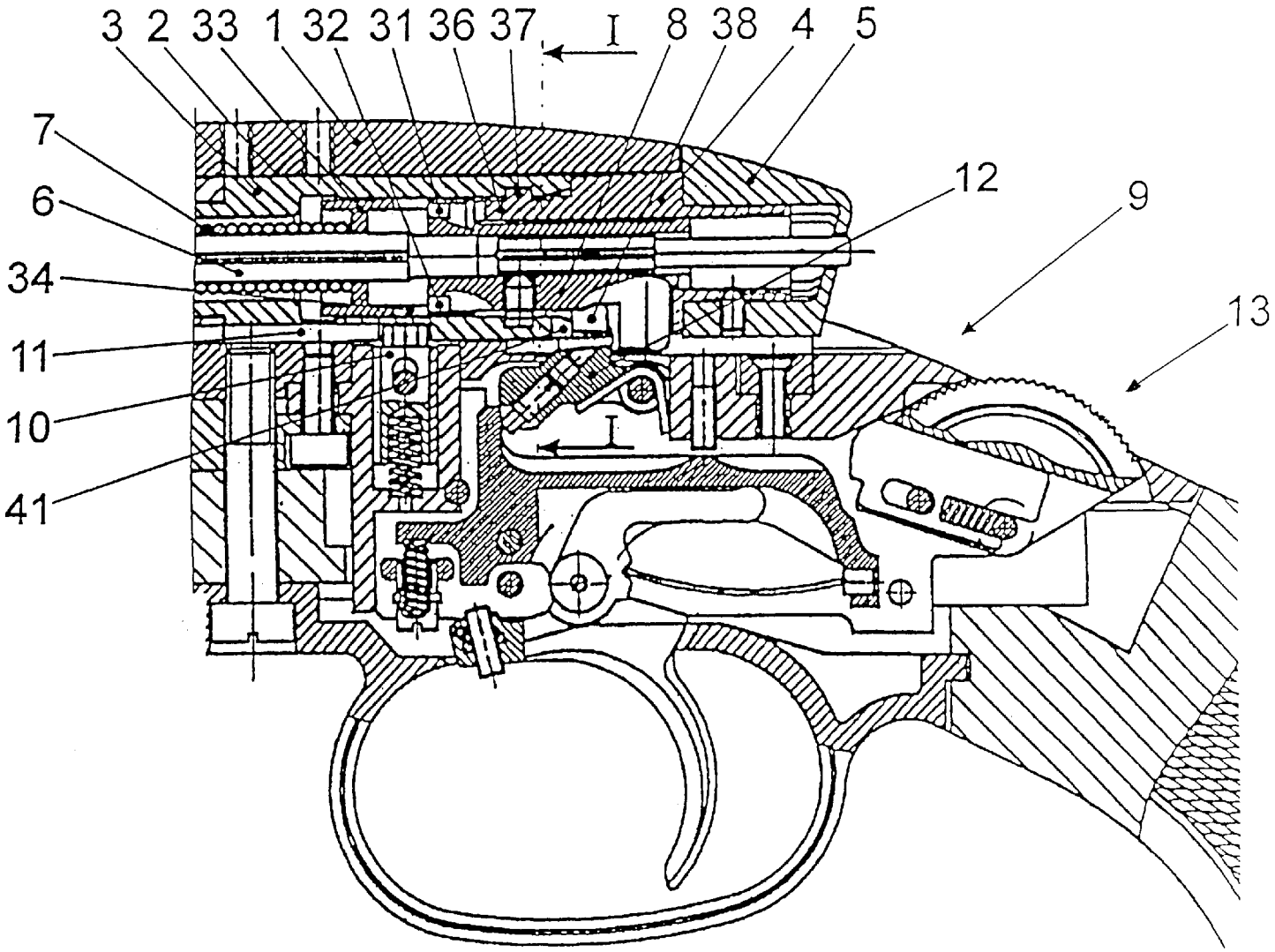
FIG. 1 shows a longitudinal section through the breech part of a rifle according to the invention.

For this purpose, the bent 8 has a release plunger 30 underneath at its rear end. Two cocking teeth which are offset through 180° are provided at the front end of the bent, an upper tooth 31 and a lower tooth 32. When the firing spring 7 is being cocked, these teeth interact with a cocking guide 34, which is formed on a cocking cam bush 33. This cocking cam bush 33 can be moved longitudinally, but is guided in a rotationally fixed manner in the interior of the breech body 3, with the firing pin spring 7 abutting against it. At its front end, the plug 4 forms a guide sleeve 36 which can be rotated with respect to the breech body 3, and thus with respect to the cocking cam bush 33. However, it is connected to the breech body via segments 37 in the axial direction, which are guided in an inner circumferential groove in the breech body 3. The figure does not show interruptions in the groove, which allow disassembling in a specific angular position. A longitudinal slot 38 is provided on the underneath of the plug 4, through which slot the release plunger 30 projects. The firing pin 6 is connected in a rotationally fixed manner through this slot 38 to the plug 4. At its front end, the guide sleeve 36 has studs (not shown) which are offset through 180°, against which the firing pin spring 7 presses the cocking guide 34. The interaction of the cocking cam bush 33, the bent 8 and guide sleeve 36 is described in more detail in the simultaneously submitted Application WO 97/47941 from the applicant, to whose contents reference is hereby made. A recess 41 is provided on the rear edge of the breech body 3 and, in the firing position when the safety catch has been released, allows the release plunger 30 to move forward. In all the other safety states, the recess 41 is rotated with respect to the release plunger 30—the firing pin cannot be actuated. This results in a safety device which acts directly on the firing pin, a so-called bolt safety device.

Figure 2:
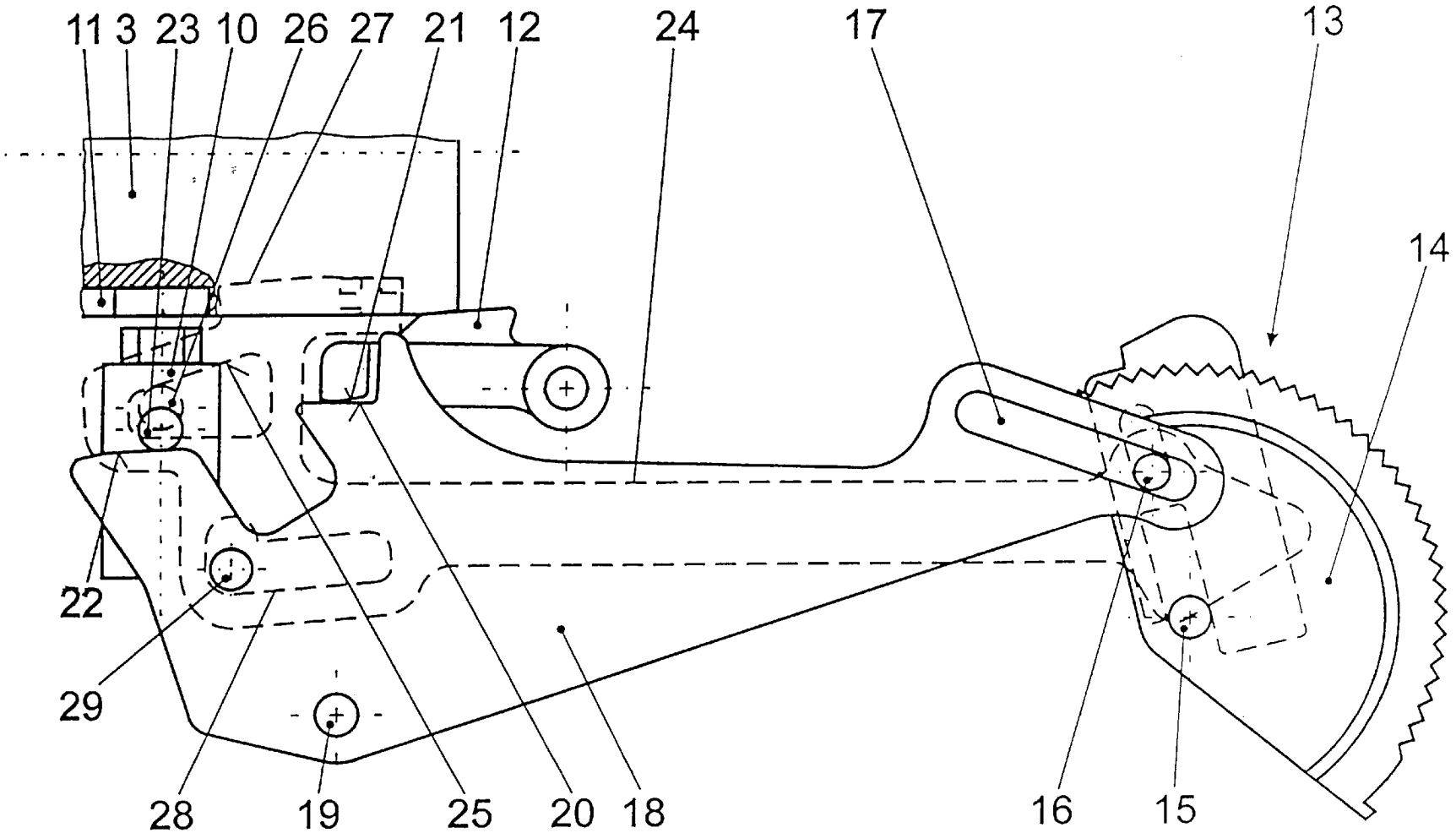
FIG. 2 shows the layout of the parts that are essential to the invention, in a first position.

FIG. 2 shows, schematically, the safety members, which are likewise fitted on the trigger housing, and some of which can be arranged in front of or behind the trigger housing, in the viewing direction. There is no need to describe the normal contents of the trigger housing 9 in any more detail. A safety catch 13 is fitted at the rear end of the trigger housing 9, accessible from the butt grip of the rifle. It consists of a knurled segment 14 which can be rotated about a shaft 15 and has a coupling pin 16 which projects transversely on both sides. On the side facing the viewer, this coupling pin 16 engages in a slot 17 in a safety element 18. This is a two-armed lever which can pivot about the shaft 19 and on which a first stop edge 20 and a second stop edge 22 are formed, at some distance above the shaft 19. In the safe position shown in this FIG. 2, the first stop edge 20 is located directly underneath a stop surface 21 of the catch 12, and the second stop edge 22 is located under a first transverse pin 23 in the breech holder 10.

A slide rod 24 is located behind the trigger housing 9, the majority of the slide rod 21 being covered by the trigger housing 9, and thus being shown by dashed lines. The coupling pin 16 once again engages in its rear end. A control ramp 25 is stamped out in the front part of the slide rod 24 and interacts with a second transverse pin 26 in the breech holder 10. The second transverse pin 26 and the first transverse pin 23 may be a simple component, which projects to the right and the left out of the breech holder 10. Furthermore, a third stop edge 27 is formed right at the top on the front part of the slide rod 24 and interacts with the breech body 3, in a manner which will be described in more detail later. The front part of the slide rod 24 is, finally, also guided by a stamped-out guide slot 28, in which a guide pin engages, which is mounted on the trigger housing.

Figure 3:
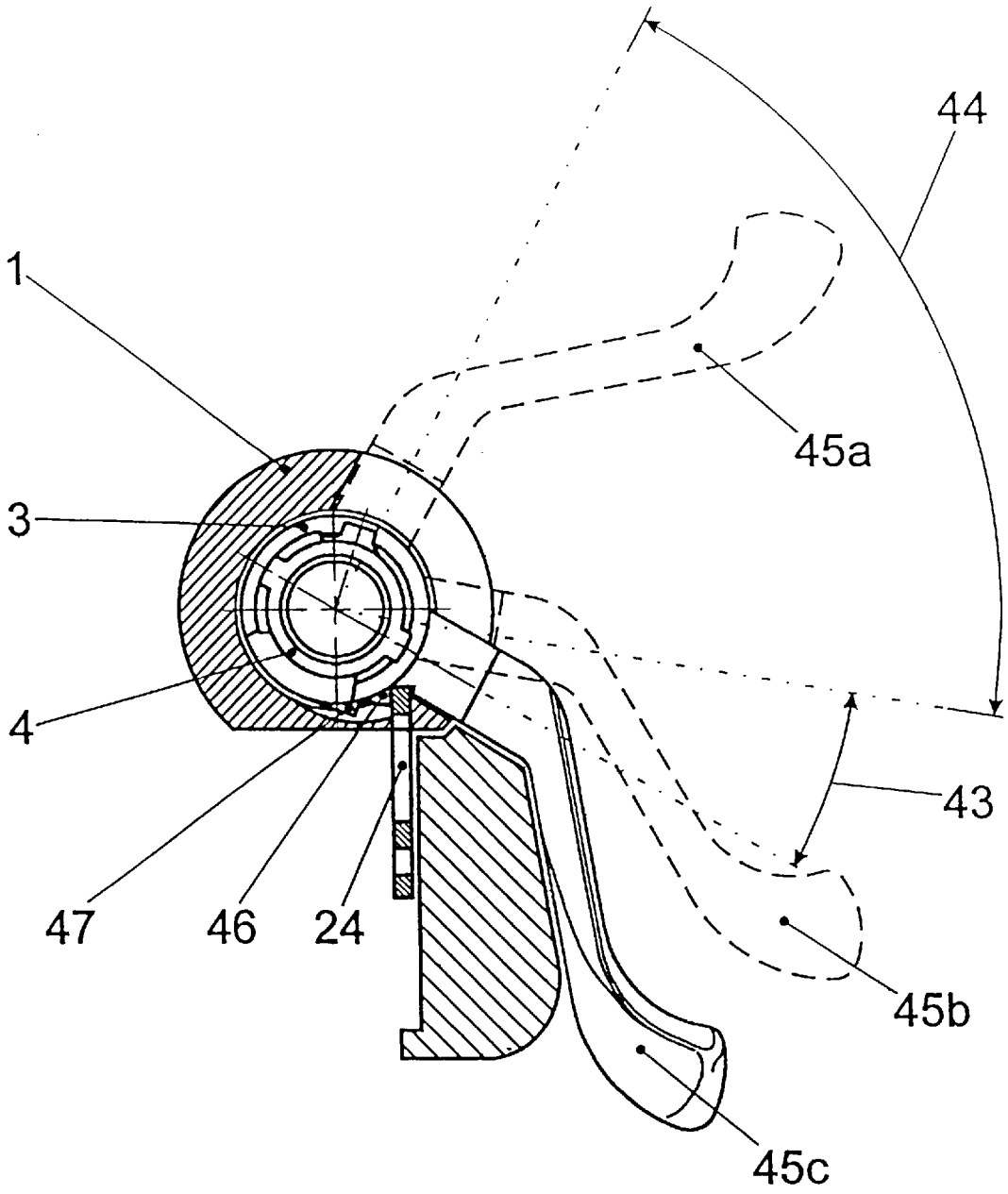
FIG. 3 shows a section along the line I—I in FIG. 1, enlarged and in the position in FIG. 2.

The cross section in FIG. 3 shows a bolt handle 45 which is integrally or permanently connected to the breech body 3, illustrated in three different positions. In the position 45*a*, the breech body 3 is unlocked and can be moved in the longitudinal direction; rotating it onward through a specific angle 44 in the clockwise direction, corresponding to the construction of the interlock (which is not illustrated) of the breech body, a position 45*b* is reached, which is the firing position; rotating it onward through a relatively small angle 43, a safe-for-transportation position is reached, in which the bolt handle rests very closely against the stock, which is indicated by 50. This position corresponds to that shown in FIG. 2.

The plug 4 and the breech body 3 are also located in this position 45*c*. A first latching tab 46 running in the circumferential direction and a second latching tab 47 can be seen on the breech body 3, following one another in the clockwise direction. The latter latching tab is considerably broader in the longitudinal direction than the first latching tab 46. The slide rod 24 is shown only cut away, and is guided on the trigger housing 9. In the position shown, the first latching tab 46 is pressed against the slide rod 24 by the force of the firing pin spring—as is explained in more detail in the application of equal priority cited above. The breech body 3 is thus held firmly in the safe-for-transportation position. Since the guide pin 29 is located in the branch of the guide slot 28 that leads upward, the slide rod 24 can move downward against the force of the spring acting on the breech holder, when the breech body is moved to the safe-for-transportation position. Using the safety catch 13 to move the slide rod 24 to the firing position releases the first latching tab 46, and the breech body 3 jumps to the firing position, corresponding to the bolt handle position 45*b*.

Figure 4:
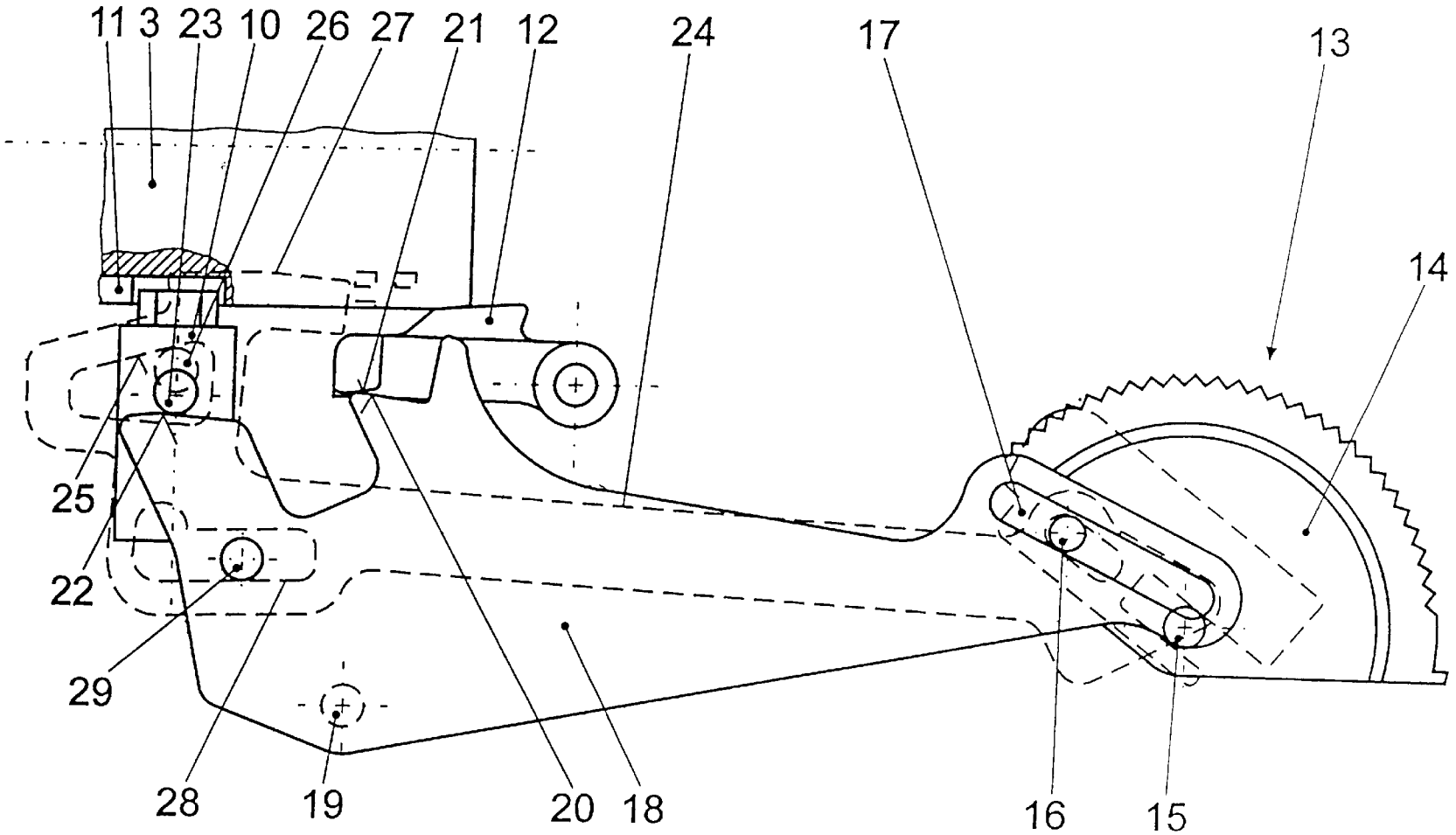
FIG. 4 shows the layout of the parts that are essential to the invention, in a second position.

This position is shown in FIG. 4. The safety element 18 is rotated counterclockwise by rotating the knurled segment 14, but the first stop edge 20 is nevertheless still located under the stop surface 21 of the catch 12. In addition, the slide rod 24 is moved forward. These two movements result on the one hand in the control ramp 25 being moved so far forward that the breech holder 10 is pushed by its spring into the uppermost position, in which the breech body 3 can no longer be pulled entirely out of the housing 1. On the other hand, the slide rod can now no longer move downward, owing to the guide slot 28. When the knurled segment 14 is in this position, the breech body 3 can no longer be moved to the safe-for-transportation position.

Figure 5:
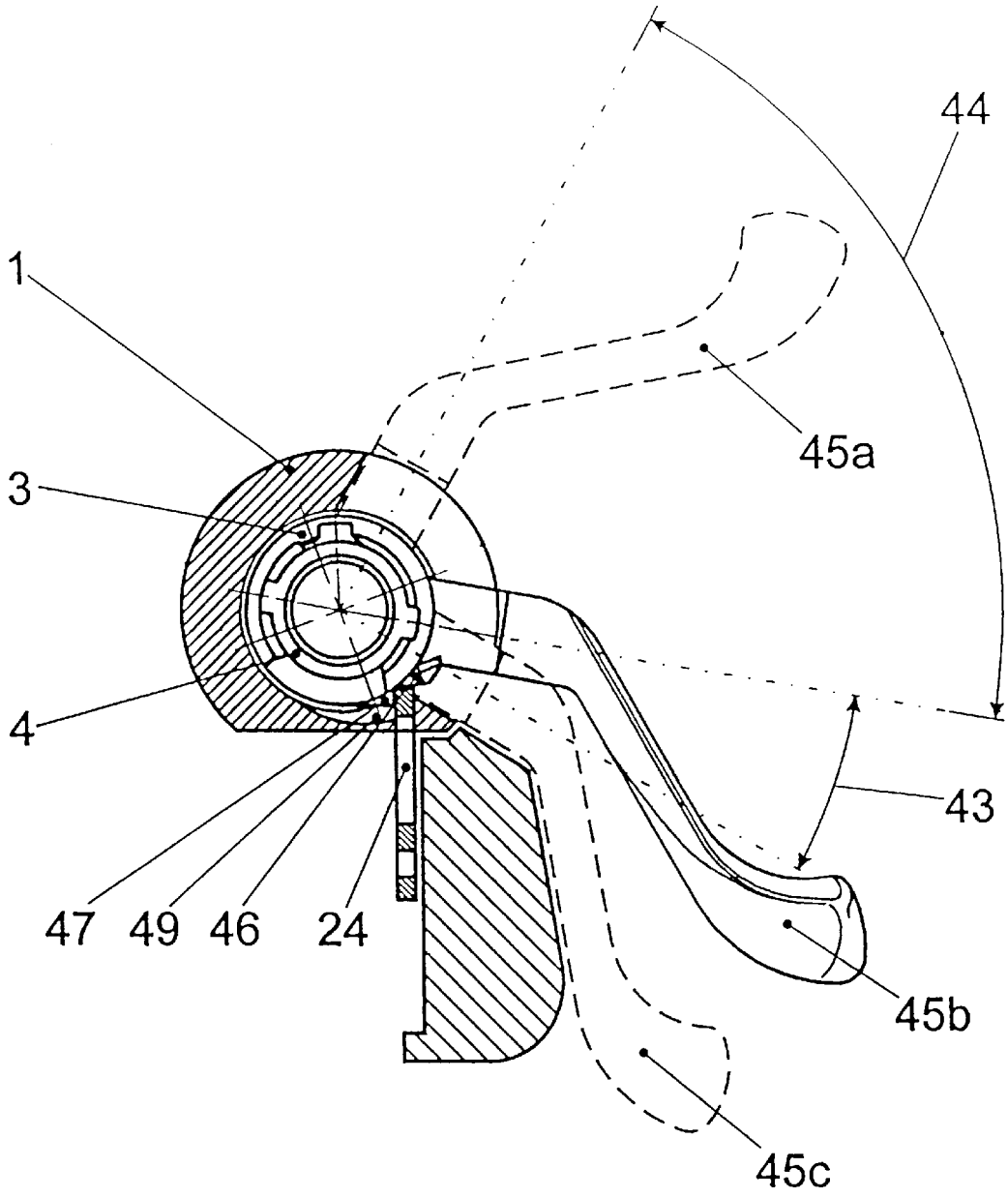
FIG. 5 shows a section along the line I—I in FIG. 2, enlarged and in the position in FIG. 4.

In FIG. 5, it can be seen that the second latching tab 47 is resting against the slide rod 24. A turned-out region 49, which is wedge-shaped in the circumferential direction, is provided in order to create space for the two latching tabs 46, 47 in the breech housing 1.

Figure 6:
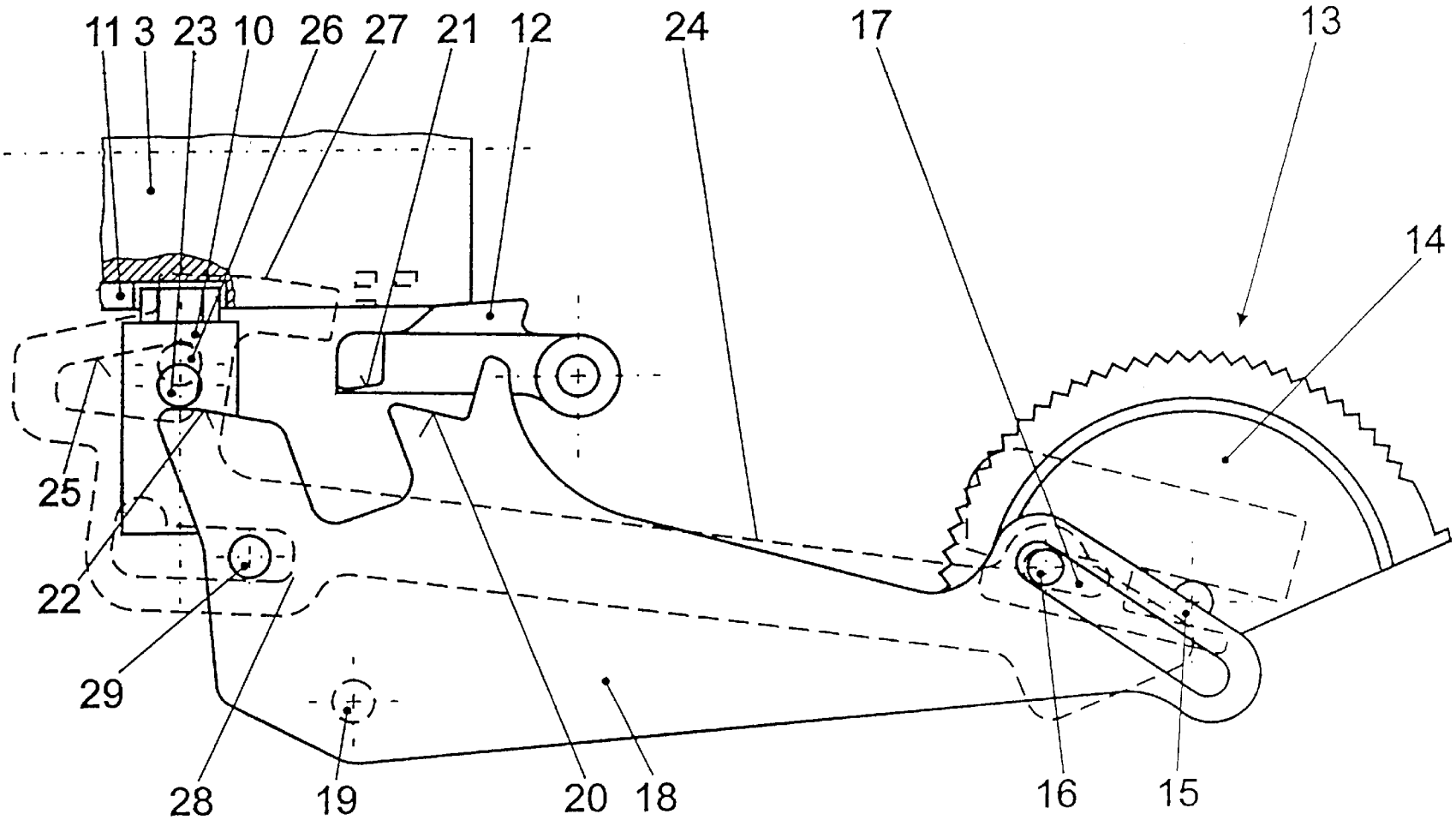
FIG. 6 shows the layout of the parts that are essential to the invention, in a third position.

In the position shown in FIG. 6, in which the safety catch has been released completely, the safety element 18 has been rotated further in the clockwise direction. The first stop edge is now no longer located under the stop surface 21 of the catch 12, the bolt safety device is released and a shot can be fired. Furthermore, the second stop edge is immediately under the first transverse pin 23, so that the breech holder 10 can no longer be lowered; when the rifle safety catch has been released, the breech body can thus no longer be entirely removed from the housing.

In this way, not only are all conceivable safety functions provided, but they can also be controlled from one operating part, using simple means.

What is claimed is:

1. In a rifle having a housing and a butt grip, a breech body mounted on the housing, an operating part located on the butt grip, the operating part being operatively connected to a catch of a release plunger, a firing pin having a firing pin spring which biases the release plunger to a loaded position, and a breech holder engaging a guide groove provided in the breech body and a spring for biasing the breech holder into position for limiting movement of the breech body, the improvement which comprises:

a. the operating part is connected to a safety element and to a slide rod, b. the catch has a stop surface, and the breech holder has a first transverse pin, c. a safety element has a first stop edge and a second stop edge wherein the first stop edge is located against the stop surface of the catch, and the second stop edge is located against the first transverse pin of the breech holder when the safety element is in first safe position, and d. the slide rod has a control ramp which interacts with a second transverse pin in the breech holder, in a second safe position.

2. The safety device for rifles as claimed in claim 1, wherein the safety element comprises a two-armed lever which can rotate about an axis located somewhat under the first stop edge, said safety element has a slot on one end which is guided on a pin located on the operating part and on the other end the second stop edge.

3. The safety for rifles as claimed in claim 1, wherein the safety element is arranged on one side of the breech holder, and the slide rod is arranged on the other side of the breech holder.

4. The safety device for rifles as claimed in claim 1, wherein the breech body has a first circumferential tab, and the slide rod has a third stop edge which fixes the first circumferential tab in the further safe position of the operating part, so that the breech body cannot be moved to its unlocked position.

5. The safety device for rifles as claimed in claim 4, wherein the breech body has a second circumferential tab which is shorter in the longitudinal direction than the first circumferential tab and rests against a third stop edge on the slide rod when the breech body is in a safe-for-transportation position and the operating part is in the second safe position.

6. The safety device for rifles as claimed in claim 5, wherein the breech body is held in the safe-for-transportation position against the force of the firing-pin spring by the interaction of the third stop edge and the second circumferential tab, when the operating part is in the second safe position.

* * * * *